US010315097B2

(12) United States Patent
Wood, V

(10) Patent No.: US 10,315,097 B2
(45) Date of Patent: Jun. 11, 2019

(54) MOTORIZED SNOWBOARD SYSTEM

(71) Applicant: Thomas E Wood, V, Darby, MT (US)

(72) Inventor: Thomas E Wood, V, Darby, MT (US)

( * ) Notice: Subject to any disclaimer, the term of this patent is extended or adjusted under 35 U.S.C. 154(b) by 0 days.

(21) Appl. No.: 15/655,000

(22) Filed: Jul. 20, 2017

(65) Prior Publication Data

US 2018/0021663 A1 Jan. 25, 2018

Related U.S. Application Data

(60) Provisional application No. 62/364,633, filed on Jul. 20, 2016, provisional application No. 62/447,616, filed on Jan. 18, 2017.

(51) Int. Cl.

| | |
|---|---|
| ***A63C 5/08*** | (2006.01) |
| ***A63C 5/035*** | (2006.01) |
| ***A63C 5/03*** | (2006.01) |

(52) U.S. Cl.

CPC ..... *A63C 5/085* (2013.01); *A63C 5/03* (2013.01); *A63C 5/035* (2013.01); *A63C 2203/12* (2013.01); *A63C 2203/22* (2013.01)

(58) Field of Classification Search

CPC ..... A63C 5/08; A63C 5/085; A63C 5/035; A63C 5/03; A63C 2203/12; A63C 2203/22

See application file for complete search history.

(56) References Cited

U.S. PATENT DOCUMENTS

| | | | |
|---|---|---|---|
| 3,645,348 | A | 2/1972 | Thompson |
| 3,809,173 | A | 5/1974 | McLeod |
| 3,853,192 | A | 12/1974 | Husted |
| 4,035,035 | A | 7/1977 | Husted |

(Continued)

FOREIGN PATENT DOCUMENTS

| | | |
|---|---|---|
| WO | PCT/SE2007/000393 | 11/2007 |
| WO | PCT/DE2008/000119 | 8/2008 |
| WO | PCT/AT2015/000097 | 1/2016 |

OTHER PUBLICATIONS

John Turi, Snowboard through the city streets with LEIF's electric freeboard (Aug. 21, 2014).

(Continued)

*Primary Examiner* — Erez Gurari

(74) *Attorney, Agent, or Firm* — Haffey Vap PLLC; Mitchell J. W. Vap

(57) ABSTRACT

The subject invention provides a snowboard that is propelled over the snow by a battery powered motor/wheel array. The preferred embodiments include a pair of motor/wheel arrays disposed on both sides of the board, on which are fitted specialized snow propellers designed for various snow conditions. The motor and wheel array are attached to the snowboard with a universal mounting plate, which utilizes any snowboard's standard binding mounting holes or channels. The motor/wheel array can be mounted to the board with L shaped brackets, or alternatively with spring loaded hinges. The motor/wheel arrays can be elevated with spacers, which position the wheels slightly lower than the deck of the board to provide traction during propulsion. Shock absorbers can also be utilized to provide downward force to the motor/wheel arrays, and allow upward articulation to accommodate inclined terrain.

38 Claims, 9 Drawing Sheets

(56) References Cited

U.S. PATENT DOCUMENTS

| | | | | |
|---|---|---|---|---|
| 4,600,073 | A | 7/1986 | Honett | |
| 4,984,648 | A | 1/1991 | Strzok | |
| 5,662,186 | A | 9/1997 | Welch | |
| 6,435,290 | B1 | 8/2002 | Justus et al. | |
| 6,698,540 | B1 | 3/2004 | Decker, Jr. | |
| 6,725,959 | B1 | 4/2004 | Shea et al. | |
| 7,434,644 | B2 | 10/2008 | Wier | |
| 7,900,723 | B2 | 3/2011 | Brazier | |
| 8,091,671 | B1 * | 1/2012 | Horsey | A63C 5/085 180/180 |
| 8,210,304 | B2 | 7/2012 | Baldwin | |
| 8,596,399 | B1 | 12/2013 | Gauld | |
| 8,844,664 | B1 | 9/2014 | Decker, Jr. | |
| 8,991,541 | B1 | 3/2015 | Maier | |
| 9,004,213 | B2 | 4/2015 | Larson et al. | |
| 2004/0154849 | A1 | 8/2004 | Fodor | |
| 2009/0255745 | A1 | 10/2009 | Kukowski et al. | |
| 2016/0158635 | A1 | 6/2016 | Aders | |

OTHER PUBLICATIONS

Wayfair, Mattracks Powerboard—Gas—Powered Motorized Snowboard (Dec. 2008).
Wackyboards, Electric Snowboard (?).

* cited by examiner

MOTORIZED SNOWBOARD SYSTEM

CROSS-REFERENCE TO RELATED APPLICATIONS

This application claims the benefits of U.S. Provisional Application No. 62/364,633, filed on Jul. 20, 2016, and U.S. Provisional Application No. 62/447,616, filed on Jan. 18, 2017, the disclosures of which are hereby incorporated by reference in their entirety including all figures, tables, and drawings.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

There are often two camps on a ski hill; skiers and snowboarders. Skiers argue that a long tradition, maneuverability, and the ability to glide their skis to move along the flats on ungroomed snow is superior to snowboarding. In steep, ungroomed, backcountry territory, a snowboard offers a large, stable, platform on which to ride. Snowboarders claim the effortless floating sensation felt while riding on ungroomed powder is unparalleled. Yet, the fact remains that travelling on flats both in and out of bounds remains problematic for snowboarders compared to those on skis. To travel on flats, snowboarders must release one foot from its binding to push the snowboard similar to how one propels a skateboard. This movement is inefficient, exhausting, and results in much lost time and energy if one must propel the snowboard across a long flat. In soft, ungroomed snow, the snowboarder's propelling foot will posthole when trying to push their board, which often results in the snowboarder getting stuck and having to release both feet from their bindings to get unstuck. The snowboarder may then need to hike through the snow to get to a ski lift, or other rallying destination. Often, snowboarders must depend on a skier or snowmobiler to give them a tow to their destination.

To overcome those shortcomings there have been numerous attempts to add power to a snowboard to not only allow a snowboard to move along level snow surfaces but to also move it along and up trails to those coveted backcountry spots. See, for example, U.S. Pat. Nos. 4,600,073; 4,984,648; 5,662,186; 6,698,540; 6,848,527; 7,434,644; 7,900,723; 7,905,310; 8,091,671; 8,205,696; 8,844,664; and 8,991,541, as well as, International Publication Nos. WO 2007/123469 and WO 2008/098541. However, these attempts to add power to snowboards have required that the board be truncated, have cumbersome and awkward modifications made to it, or alter the board so that the rider no longer feels as if they are riding a traditional snowboard.

Therefore, need remains for a motorized snowboard whose power system is capable of propelling the snowboarder across flat or inclined terrain, is unobtrusive, and allows the rider to ride the board naturally while going downhill.

All patents, patent applications, provisional patent applications and publications referred to or cited herein, are incorporated by reference in their entirety to the extent they are not inconsistent with the teachings of the specification.

BRIEF SUMMARY OF THE INVENTION

The subject invention solves the shortcomings of the other powered snowboards addressed above. The subject invention provides a snowboard that is propelled over the snow by a battery powered motor/wheel array. The preferred embodiments include a pair of motor/wheel arrays disposed on both sides of the board, on which are fitted specialized snow propellers designed for various snow conditions. The motor/wheel array can be attached to the snowboard with a universal mounting plate, which utilizes any snowboard's standard binding mounting holes or channels. The motor/wheel array can be mounted to the board or universal mounting plate with L shaped brackets, or alternatively with spring loaded hinges. The motor/wheel arrays can be elevated with spacers, which position the wheels fitted with snow propellers slightly lower than the deck of the board to provide traction during propulsion. Shock absorbers can also be utilized to provide downward force to the motor/wheel arrays, and allow upward articulation to accommodate inclined terrain. In one embodiment, a single shock absorber connected between the two motor/wheel arrays provides outward pressure to both motors. Rotation allowed by the motor casing/L bracket connection translates into downward force of the snow propellers into the snow surface. Alternatively, each motor/wheel array combination can be mounted on a hinge and have its own shock absorber independently connecting each motor/wheel array to the snowboard, or universal mounting plate. Attaching the motors to the board on hinges and/or using shock absorbers applies a downward force through the wheels fitted with snow propellers into the snow surface. Driving the wheels into the snow not only increases traction, but the upward force from the snow upon the motor/wheel array applies lift to the board through the system.

Similarly, any increase in the amount of downward force of the motor/wheel arrays effectively lightens the weight of the rider and board, which buoys the board on the snow. This reduces the negative impact the added weight of the motor and power source may have on control and maneuverability of the board.

The articulating motion of the motor/wheel arrays allow the rider to utilize the snowboard's edges for directional control on varying inclines. The invention could utilize adjustable shock absorber pressure means to allow the rider to customize the downward force of the motor/wheel array for varying snow conditions. Further, pressure could be adjusted for the weight, skill, and size of the rider.

Another embodiment of the invention utilizes two independent motor/wheel arrays, which allows each motor/wheel array to be locked in the "up" position to completely disengage the propellers from the snow to allow for normal downhill riding. Different designs of propellers with features specific to the existing snow conditions can be interchanged to match existing snow conditions.

The subject invention allows the rider to maintain the experience of true snowboarding. The ultimate snowboard experience is when the rider feels weightless achieving the "flow" where there is a synergy between body and board the rider making adjustments with minimal almost unperceivable cues from the board. Edging embodies this sensation as the rider begins to mentally replace their legs with the edges of the board. The subject invention allows the board to contact the snow fully and frees the edges of the board to be fully used by the rider. The position and placement of the motorized features of the board minimize intrusion into the rider's synergy with the board. The system of the subject invention removes the limitations of friction and gravity while maintaining the natural state of the board-rider connection and allows for an optimally intuitive experience on the part of the snow-sport enthusiast. To use the subject device, the rider simply straps both feet into their bindings and uses the motorized power of the system to get them to their next riding destination. No more releasing a foot and kicking across a flat. No more post holing. No more jumping or bunny hopping to start movement. Once forward motion begins, the rider assumes the natural stance, weight distribution, lean and edging to maneuver the subject motorized board.

DETAILED DESCRIPTION OF THE INVENTION

Figure 1:
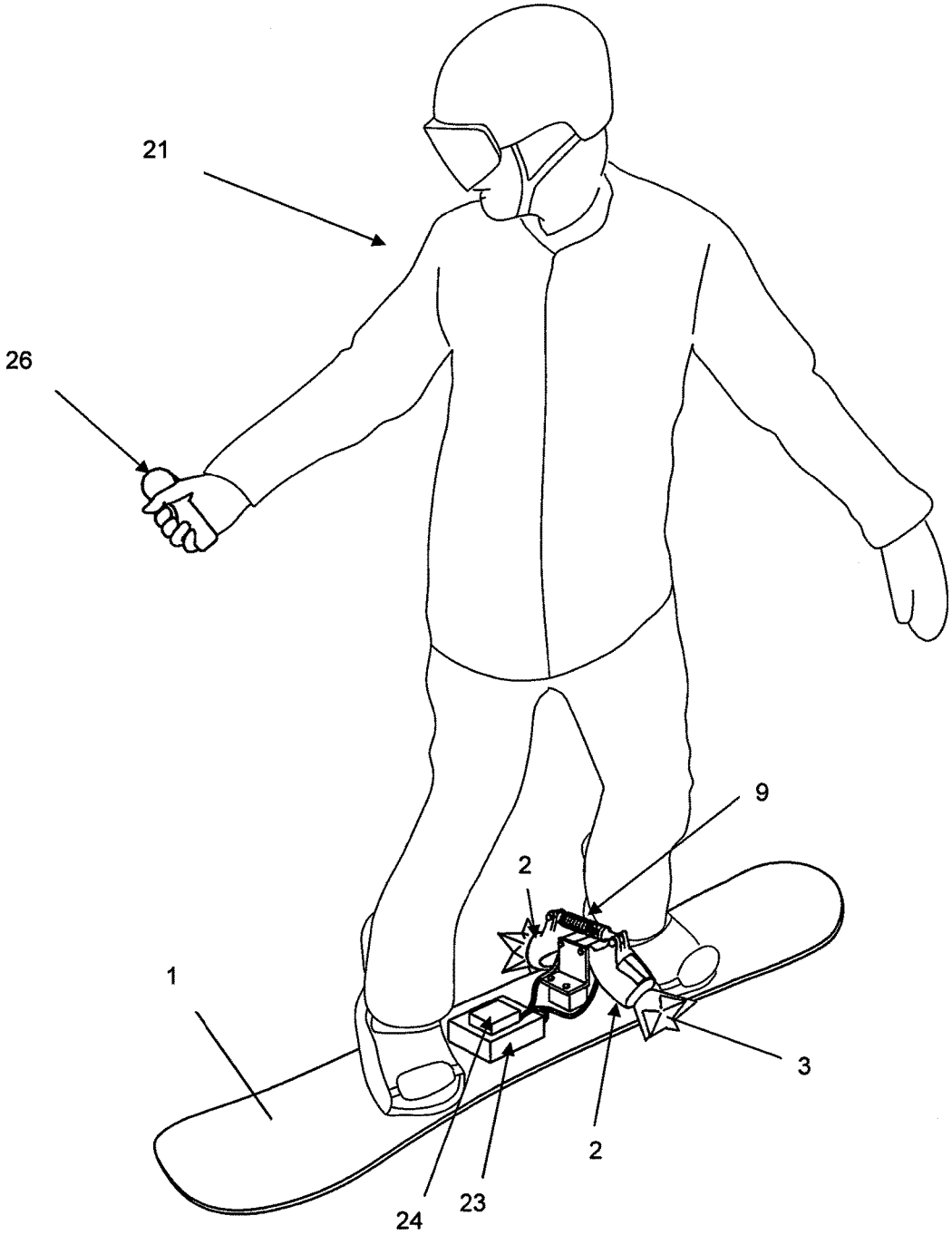
FIG. 1 is a perspective view of a snowboarder riding a motorized snowboard.
Figure 2:
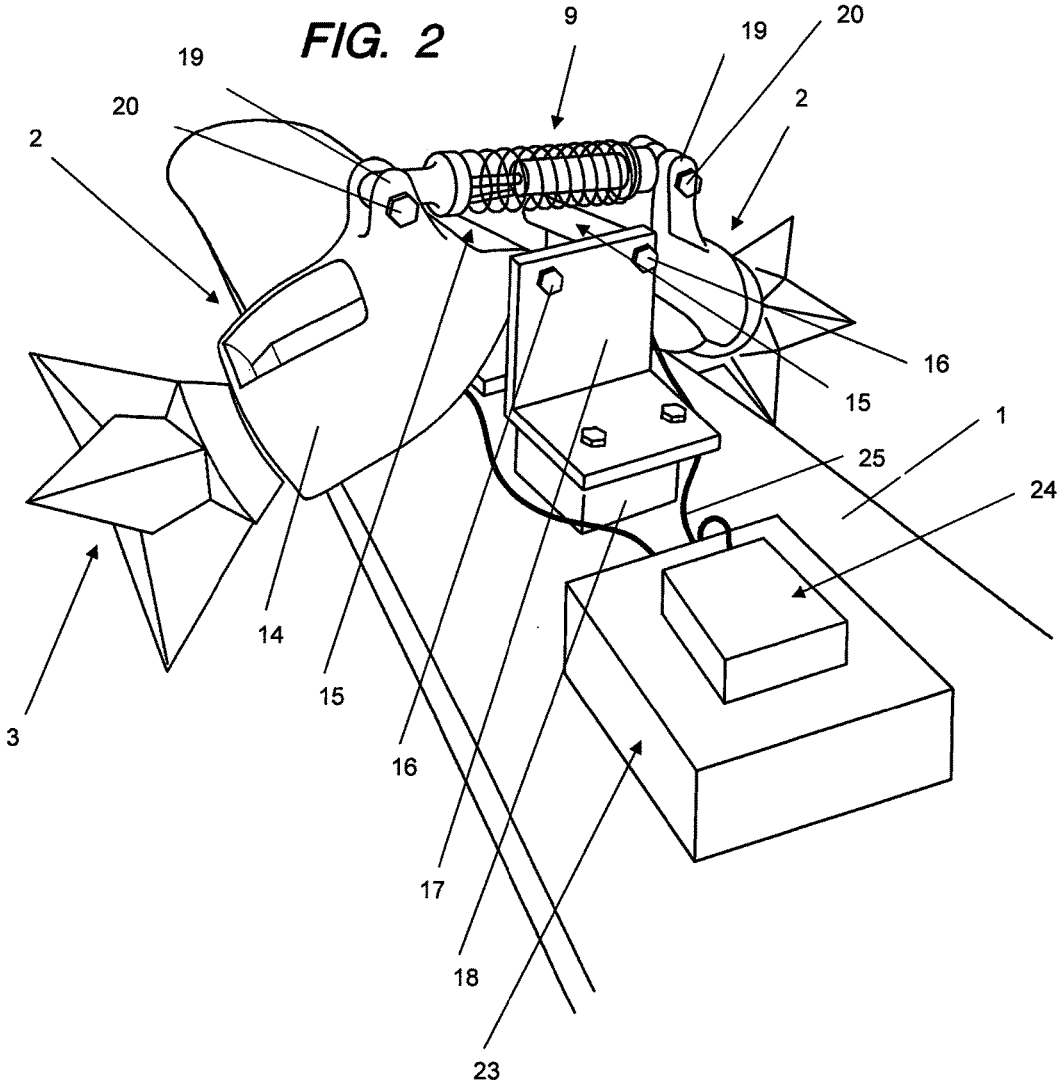
FIG. 2 is a perspective view of a preferred embodiment of the subject invention.
Figure 3:
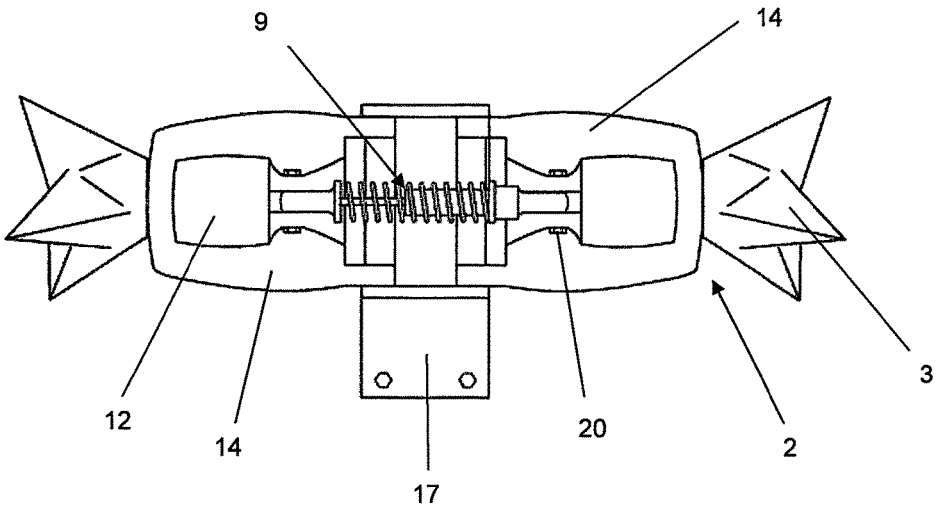
FIG. 3 is a top elevational view of the motor/wheel array of a preferred embodiment of the subject invention.
Figure 4:
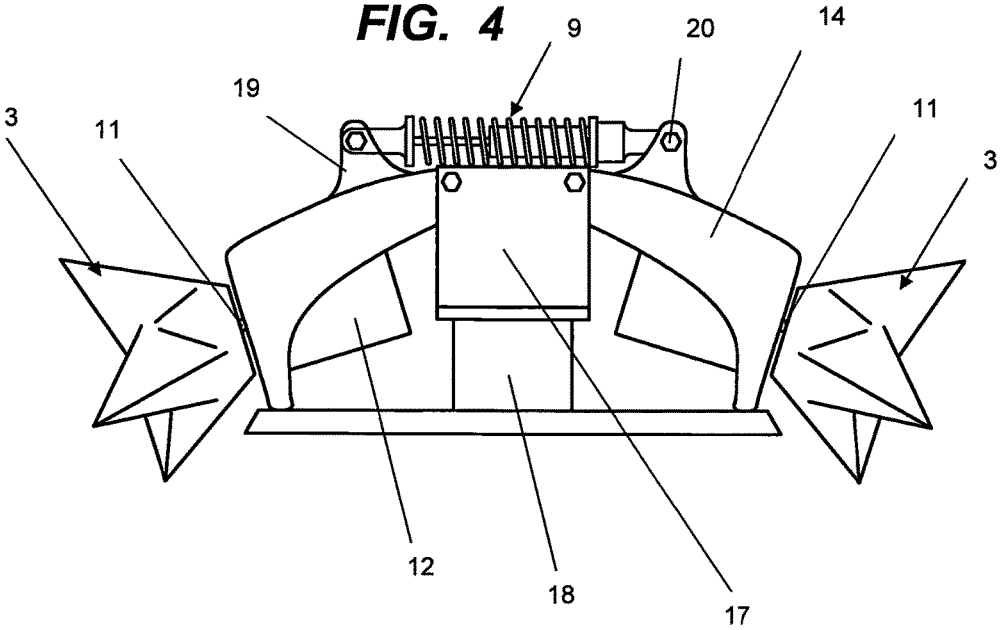
FIG. 4 is a front elevational view of the motor/wheel array of the subject invention.

The subject invention provides a snowboard 1 that is propelled over the snow by a battery powered motor/wheel array 2, which is fitted with specialized snow propellers 3 with features designed for various snow conditions. In preferred embodiments, a motor/wheel array 2 is disposed on either side of the snowboard 1, which provides for symmetrical contact with the snow surface 22. Said motor/wheel arrays 2 are attached directly to the snowboard 1, or with a universal mounting plate 4, which utilizes any snowboard 1 standard binding mounting holes 5 or channels 6. Said motor/wheel arrays 2 are powered by a battery pack 23, and controlled by an electronic speed control 24. A shock absorber 9 is utilized to provide downward force to the motor/wheel arrays 2 to engage the snow surface 22, and allow the motor/wheel arrays 2 to articulate according to varying terrain.

In a preferred embodiment as depicted in FIGS. 1-7, the subject invention has one pair of motor/wheel arrays 2 disposed on both sides of the snowboard 1, in front of the rear binding 10. Such placement provides for symmetrical contact with the snow surface 22, and symmetrical propulsion force on each side of the snowboard 1. Each wheel 11 is driven by its own motor 12. However, a pair of wheels could be driven by a single motor. Driving wheels with a single motor however may affect the weight and flexibility of the board.

In the preferred embodiment, a single pair of motor/wheel arrays 2 are positioned on both sides of the snowboard 1 in front of the rear foot binding 10, utilizing the universal mounting plate 4. It should be noted that multiple pairs of motor/wheel arrays 2 could be utilized on a single snowboard 1 to provide increased propulsion. For example, a second pair of motor/wheel arrays 2 could also be placed in front of the front foot binding 13 of a snowboard utilizing the universal mounting plate 4 described herein. It should be noted that since the snowboard 1 is minimally altered, quick release bindings are unaffected and such bindings remain operational.

Figure 5:
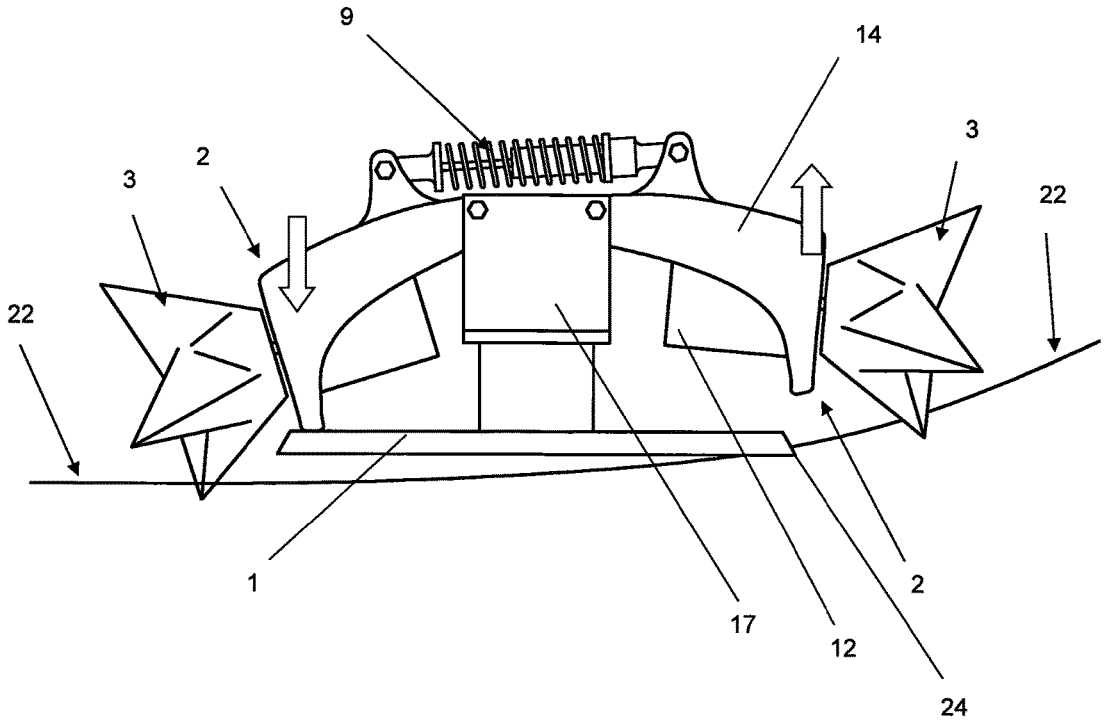
FIG. 5 is a front elevational view of a preferred embodiment of the subject invention demonstrating the articulation of the motor/wheel array on an incline.
Figure 6:
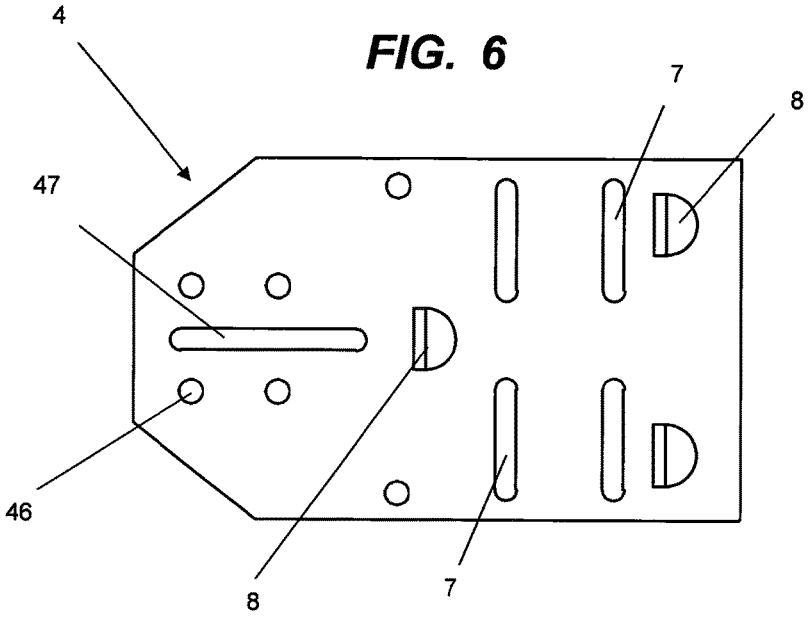
FIG. 6 is a top plan view of the universal mounting plate of the subject invention.

In this preferred embodiment, each motor 12 is encased within a motor casing 14. The proximal portion of said motor casing 14 has a mounting hole 15, which accepts a casing mounting bolt 16. Said casing mounting bolt 16 connects said motor casing 14 to two L shaped brackets 17 disposed in front of and behind the motor/wheel array 2 pair. Connecting the motor casing 14 to the L shaped bracket 17 with the casing mounting bolt 16 allows for up and down motion of the motor/wheel arrays 2 in relation to the snowboard 1 as shown in FIG. 5. While not necessary, spacers 18 can be secured underneath each L shaped bracket 17 to further elevate the motor/wheel array 2 pair according to preferred depth of snow engagement, and board width. The L shaped brackets 17 are then secured to the universal mounting plate's 4, attachment channels 7, which is then secured to the snowboard 1 utilizing the snowboard's existing mounting holes 5, or channels 6. The attachment channels 7 allow medial/lateral adjustment of the motor/wheel arrays 2 depending on rider 21 preference and snowboard 1 width.

In the preferred embodiment, the top portion 19 of each motor casing 14 is designed to accept a shock absorber mounting bolt 20, which connects a single shock absorber 9 to each motor casing 14. Said shock absorber 9, coupled with the up and down motion allowed by mounting the motor casing 14 to the L shaped brackets 17, provides the downward force necessary to engage the snow propellers 3 to the snow surface. Said shock absorber 9 also allows articulation of the motor/wheel arrays 2 while the rider 21 edges the board on inclined surfaces, while maintaining engagement of the snow propeller 3 with the snow surface 22 as shown in FIG. 5.

In this preferred embodiment, the motors 12 used to drive the wheels 11 fitted with snow propellers 3 are battery powered 36-48 volt motors 12. One skilled in the art however would understand that other motors and motor configurations would drive the board adequately. Since the exemplified motors 12 are battery powered, the battery pack 23 is conveniently placed between the feet of the rider 21 on the deck of the snowboard 1 by any adequate securing means. Central placement of the battery pack 23 in as flat as a configuration as possible provides a low center of gravity for the snowboard 1. When positioned in this manner, the snowboard's 1 motional inertia will be least affected by the weight of the battery pack 23. In the preferred embodiment, the battery pack 23 is comprised of 3 banks of 4-cell units of 3.7 volt lithium ion batteries. In the preferred embodiment, each motor 12 is connected to an electronic speed control 24, which controls the speed and directional rotation of the respective motors 12. In the preferred embodiment, 10-8 gauge wire is utilized for leads 25 from the battery pack 23 to the motors 12 and electronic speed control 24 to minimize resistance.

In the preferred embodiment, A 20-amp remote control 26 was used by the rider 21 to control the speed and direction of the motors 12. In another embodiment, the motors 12 and electronic speed control could be modulated using a smart phone. The balance and accelerometer functions within a smart phone could provide intuitive balance and thrust control for the subject invention. Using a small, flat dorsal clip-in sled, a smart phone could be attached to the top of the snowboard 1, preferably above the battery pack 23. As the rider 21 leans forward or turns downhill, the smartphone's angle would slant and cause the acceleration feature to respond with thrust to the corresponding angle experienced by the smart phone and rider 21.

An advantage of the motorized snowboard of the subject invention is that it can be ridden normally without the obtrusiveness of heavy and cumbersome motorized components. The motor/wheel array 2 mounting and placement allows the rider 21 to edge the snowboard 1 into a turn naturally. A rider 21 of a traditional non-motorized board can ride the snowboard 1 of the subject invention without having to learn new methods to control the board. As the rider 21 takes a heel-side turn, the heel-side motor/wheel array 2 lifts up to about 70° above the surface of the snowboard 1, while the toe-side motor/wheel array 2 drops to maintain symmetrical contact with the snow surface 22, and allow for natural carving of the snowboard's 1 edge 24 as shown in FIG. 5. The additional weight of the motorized components are offset by the downward force of the shock absorber 9, which provides the rider 21 the most natural ride possible. Means to adjust the pressure and tension of the shock absorber 9 could be included to allow the rider 21 to customize the ride for varying snow conditions.

Figure 11:
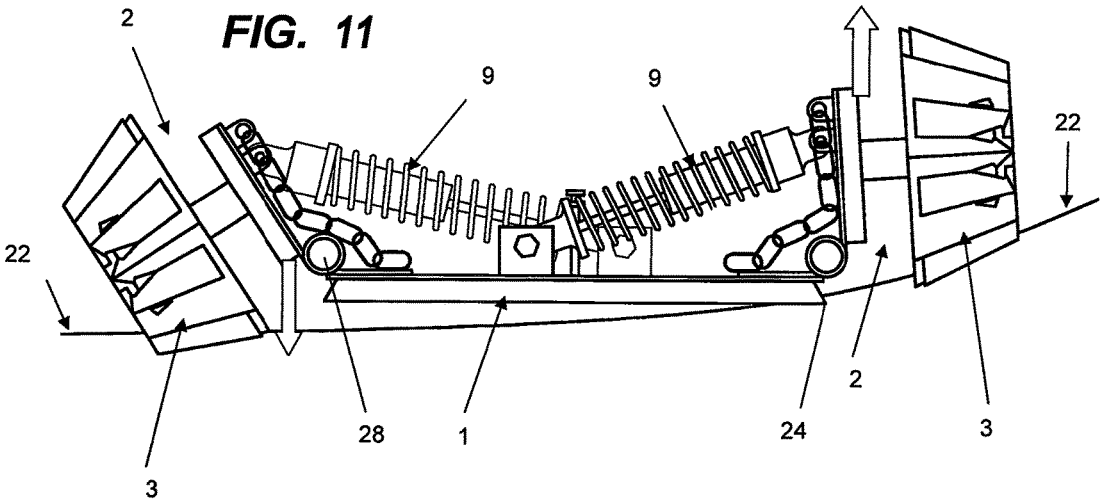
FIG. 11 is a front elevational view of another preferred embodiment of the subject invention demonstrating the articulation of the motor/wheel array on an incline.

In another embodiment, each motor/wheel array 2 is mounted to the first plate 27 of a hinge 28. The second plate 29 of said hinge 28 is then mounted to the universal mounting plate 4, which is then mounted to the snowboard 1 as described previously. Preferably, the hinge 28 is spring-loaded to provide the downward force necessary to engage the fitted snow propeller 3 with the snow surface 22, and provide shock absorption to allow for edging on inclined terrain as shown in FIG. 11. The spring-loaded hinge 28 applies pressure through the fulcrum of the hinge 28 to drive the wheels 11 fitted with snow propellers 3 into the snow surface 22 for traction. This feature can be enhanced by utilizing spacers 18, as described above, between the second plate 29 of the hinge 28 and snowboard 1, or the universal mounting plate 4 so the motor/wheel arrays 2 are elevated above the deck of the snowboard 1. The elevated motor/wheel array 22 attachment to the spring-loaded hinge 28 causes the wheels 11 fitted with snow propellers 3 to "toe-in" so the blades 29 of the snow propellers 3 extend slightly below and toward the edge 24 of the snowboard 1. In this embodiment, said hinge 28 was a 50 pound spring-loaded gate hinge.

In this embodiment, the inside surface 30 of the first plate 27 of the hinge 28 includes a hinge plate shock absorber bracket 31, which accepts a first end 32 of a shock absorber 9. A deck shock absorber bracket 33 is then secured to the deck of the snowboard 1, which accepts a second end 34 of a shock absorber 9. Alternatively, the universal mounting plate 4 includes a deck shock absorber bracket 33, which accepts the second end 34 of a shock absorber 9. A standard bolt and nut 35 or other connection means secure the shock absorber 9 to the hinge plate 31 and mounting plate 33 shock absorber brackets. Similar to the first embodiment, the addition of shock absorbers 9 allows the motor/wheel arrays 2 to articulate as the rider 21 encounters inclined terrain. As the rider 21 takes a heel-side turn, the heel-side motor/wheel array 2 lifts up to about 70° above the surface of the snowboard 1, while the toe-side motor/wheel array 2 drops to maintain symmetrical contact with the snow surface 22, and allow for natural carving of the snowboard's 1 edge 24. Means to adjust the pressure and tension of the shock absorbers 9 could be included to allow the rider 21 to customize the ride for varying snow conditions.

Figure 10:
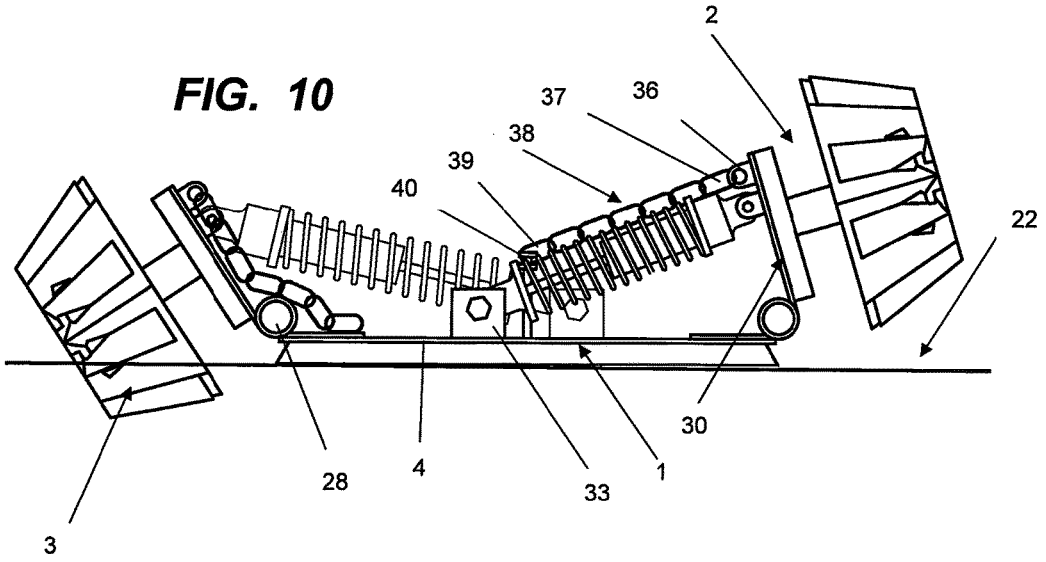
FIG. 10 is a front elevational view of another preferred embodiment of the subject invention showing one motor and wheel array in "down" position, and one motor and wheel array locked in "up" position.

A further feature of this embodiment includes means to completely disengage the motor/wheel arrays 2 from the snow surface 22 as shown in FIG. 10. The inside surface 30 of the first plate 27 of the hinge 28, is also fitted with a hinge plate chain clip 36. The first end 37 of a chain 38 or other connection means is connected to the hinge plate chain clip 36. The second end 39 of the chain 38 or other connection means can be clipped to a central chain clip 40, which is secured to the snowboard 1, or to the universal mounting plate 4. The chain 38 or other connecting means is of appropriate length so that when said second end 39 is connected to the central chain clip 40, the motor/wheel array 2 is lifted into the "up" position, and disengaged from the snow surface 22 as shown in FIG. 10.

When the motor/wheel arrays 2 are both in the "up" position, the rider 21 can experience a completely normal ride. When the rider 21 has completed his or her descent, the chains 38 or other connection means can be unclipped from the central chain clip 40, to allow the motor/wheel arrays 2 to engage the snow surface 22 for motorized propulsion.

The means to provide battery power and motor control are the same as described for the previous embodiment. In this embodiment, the battery pack 23 is comprised of 3 banks of 4-cell units of 3.7 volt lithium ion batteries. In this embodiment, each motor 12 is connected to an electronic speed control 24, which controls the speed and directional rotation of the respective motors 12. In this embodiment, 10-8 gauge wire is utilized for leads 25 from the battery pack 23 to the motors 12 and electronic speed control 24 to minimize resistance. In this embodiment, A 20-amp remote control 26 was used by the rider 21 to control the system.

Figure 13:
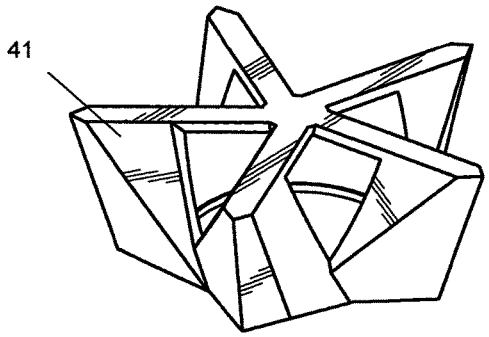
FIG. 13 is a perspective view of an embodiment of a snow propeller.
Figure 14:
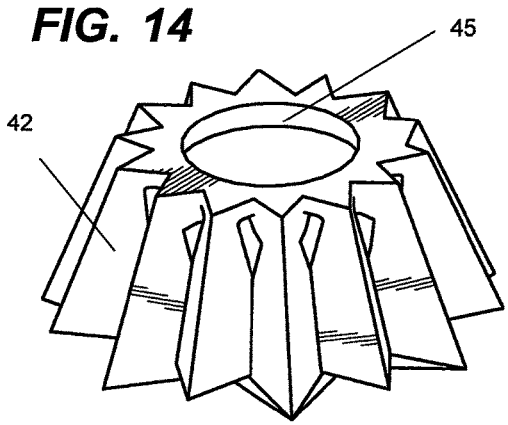
FIG. 14 is a perspective view of another embodiment of a snow propeller.
Figure 15:
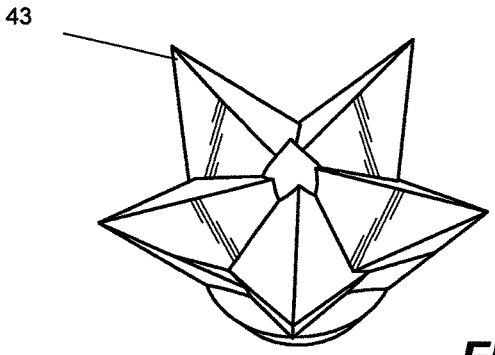
FIG. 15 is a perspective view of another embodiment of a snow propeller.
Figure 16:
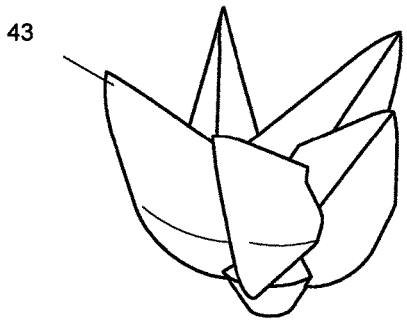
FIG. 16 is a perspective view of another embodiment of a snow propeller.
Figure 17:
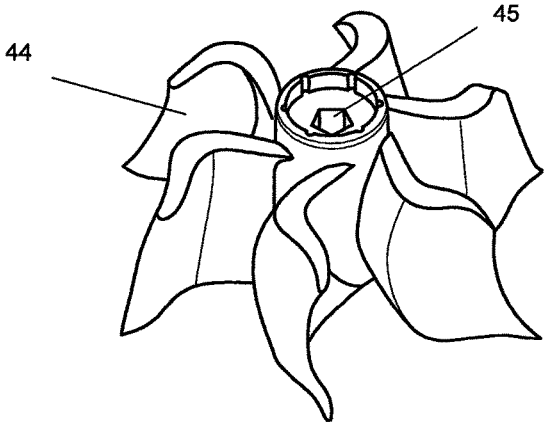
FIG. 17 is a perspective view of another embodiment of a snow propeller.

The wheels 11 fitted with snow propellers 3 of the subject invention must be able to move the snowboard 1 through the ice and snow. Larger wheels 11 provide better torque and traction. Furthermore, the addition of interchangeable snow propellers 3 can increase the power and efficiency of the subject invention in varying snow conditions. For example, star shaped propellers with thick, short blades 41 as shown in FIG. 13 are most efficient in heavy, unpacked snow conditions. Truncated propellers with a tread like pattern 42 will be most efficient in hard pack conditions such as the propeller shown in FIG. 14. Propellers with short, sharp pointed tips 43 will be most effective in hard pack or ice conditions such as those shown in FIGS. 15-16. Propellers with long, scooping blades 44 will be most effective in powder conditions such as the propeller shown in FIG. 17. Propellers are designed with attachment means 45 to be compatible with the motor's 12 wheel 11 attachment means. Therefore, propellers 3 can easily be interchanged as snow conditions change.

Figure 7:
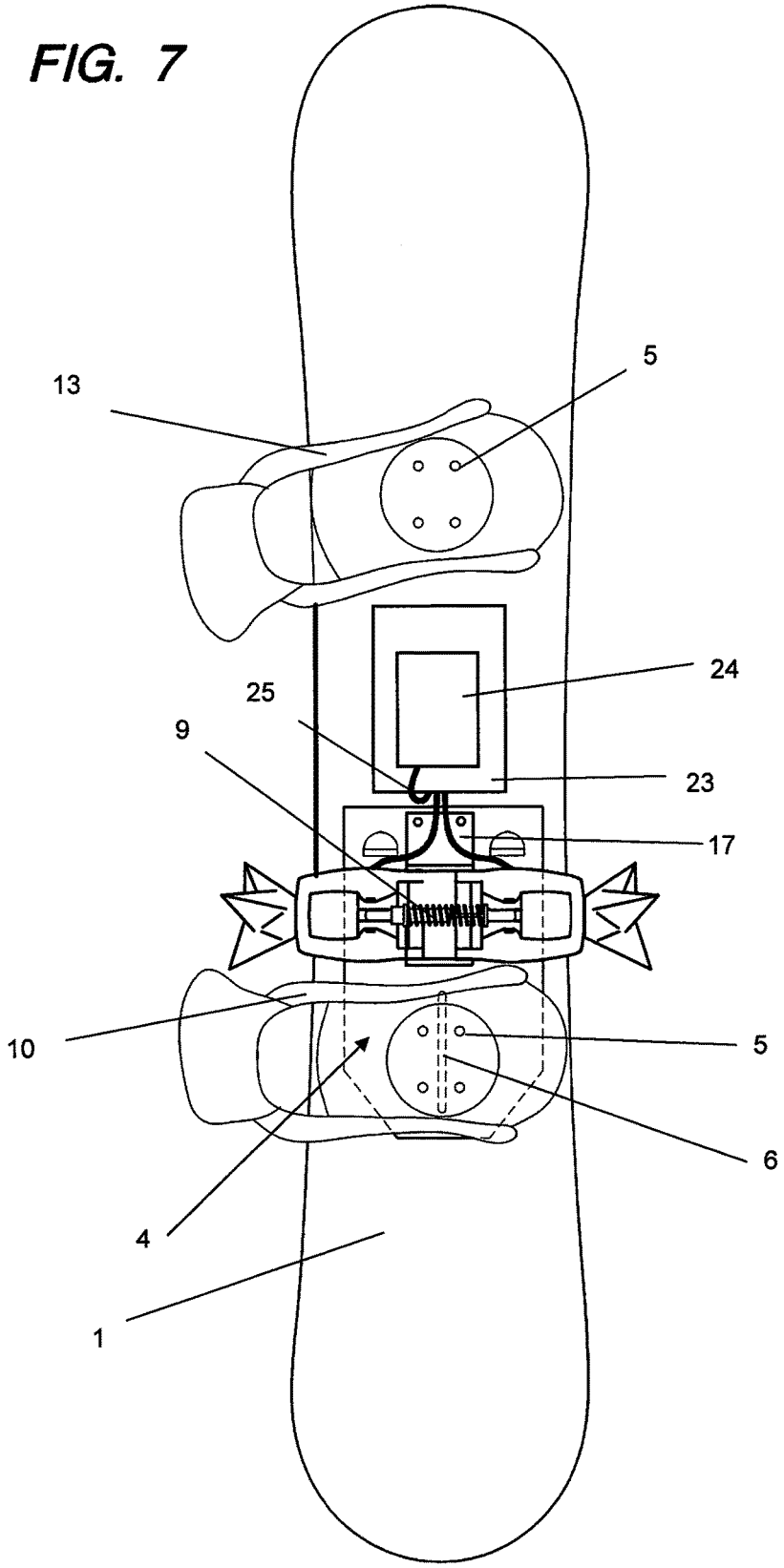
FIG. 7 is a top elevational view of the motor/wheel array in use with the universal mounting plate of the subject invention.
Figure 8:
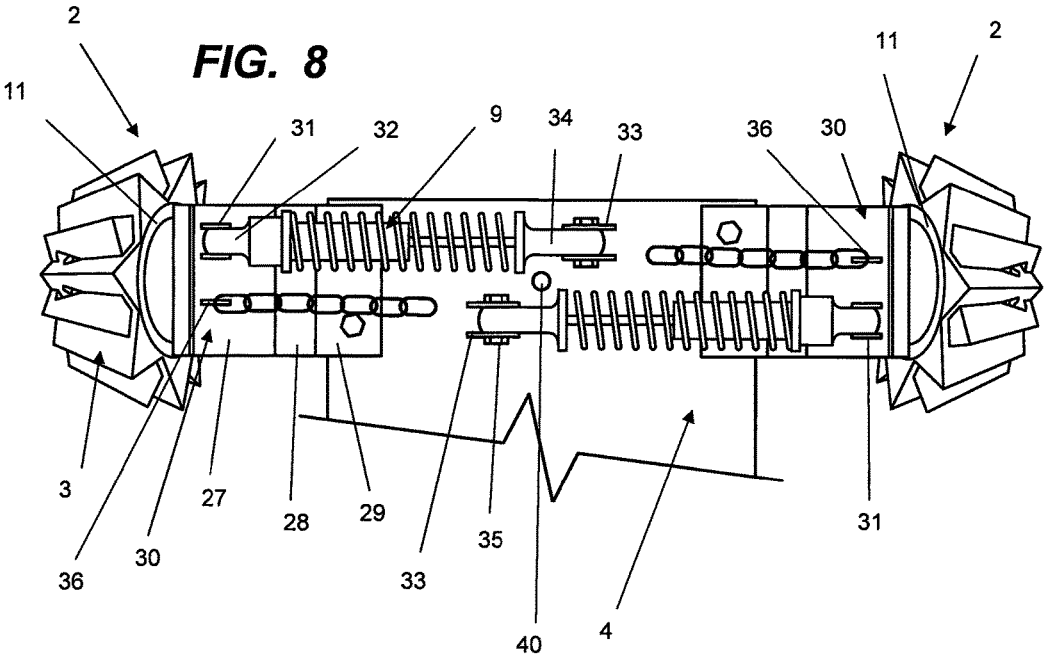
FIG. 8 is a top elevational view of another preferred embodiment of the subject invention where the motor and wheel arrays can be locked in the "up" position.
Figure 9:
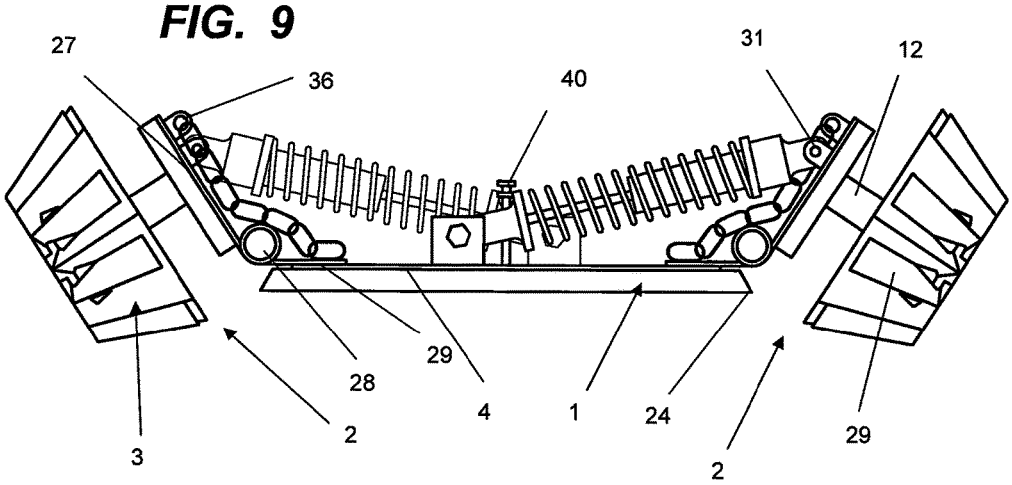
FIG. 9 is a front elevational view of another preferred embodiment of the subject invention showing motor and wheel arrays in "down" position.
Figure 12:
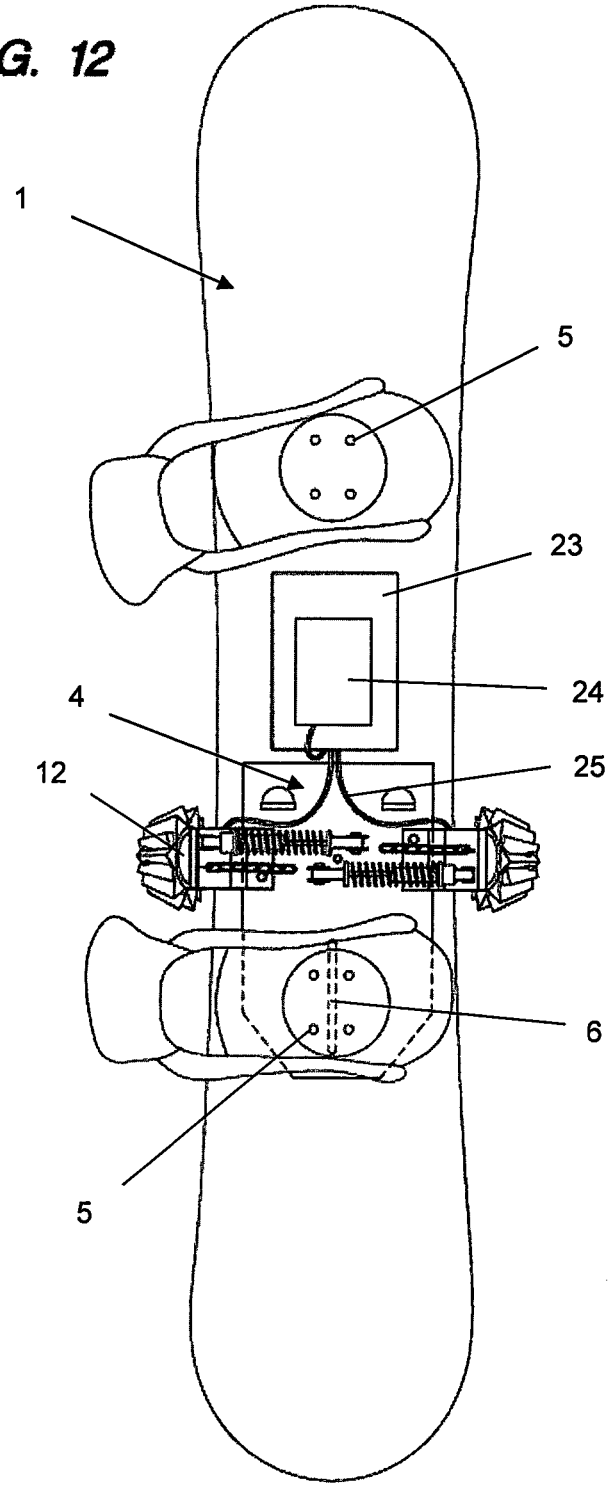
FIG. 12 is a top elevational view of another preferred embodiment in use with the universal mounting plate of the subject invention.

While the motor/wheel arrays 2, hinge 28, L-shaped brackets 17, spacers 18 and shock absorbers 9 of the subject invention can be mounted directly to a snowboard 1 by utilizing existing mounting features and adding mounting holes as necessary, a feature of the embodiments described herein is that the system can be applied to any snowboard 1 and be removable by utilizing the universal mounting plate 4 as described herein. Snowboard riders have their preferred boards. The universal mounting plate 4 allows any rider 21 to experience a motorized snowboard. Furthermore, the rider 21 will be able to keep the system if trading in an old board for a new one. The universal mounting plate 4 is drilled to match the standard binding hole pattern 46 to accommodate a snowboard with standard binding holes 5. The universal mounting plate also contains a central channel 47 to accommodate channel 6 binding mounts, but then extends past the binding to provide the mounts for the system as shown in FIGS. 7 and 12. Holes in the bottom of the universal mounting plate 4 are counter-sunk to insure the plate lays flush on the snowboard 1 deck. The universal mounting plate 4 is provided with a plurality of channels 7 and channels and hardware attachment means 8 as shown on FIG. 6, which allow the rider 21 to adjust the position of the motor/wheel arrays 2 according board size, snow conditions, and rider preference. While the universal mounting plate can be comprised of any suitable material such as metal, the preferred universal mounting plate 4 is comprised of a 0.05 to 0.1 inch thick titanium. The universal mounting plate 4 provides the rigidity necessary to effectively transfer torque between the motor/wheel arrays 2, snowboard 1, and rider 21. The universal mounting plate 4 can be configured to provide for mounting multiple pairs of motor/wheel arrays 2 to the board. Additionally, multiple universal mounting plates 4 can be mounted to the snowboard by utilizing both sets of mounting holes 5 or channels 6.

It is understood that the foregoing examples are merely illustrative of the present invention. Certain modifications of the articles and/or methods may be made and still achieve the objectives of the invention. Such modifications are contemplated as within the scope of the claimed invention.

I claim:

1. A motorized snowboard system comprising:

a. a motor;

b. mounted to a snowboard;

c. where said motor turns a wheel;

d. where said wheel is fitted with a snow propeller;

e. where said motor is mounted to said snowboard to allow said snow propeller to engage the snow surface to provide propulsion; and f. where said motor is mounted to said snowboard with a universal mounting plate.

2. The motorized snowboard system of claim 1 where mounting means are utilized to allow up and down motion of said motor, wheel, and snow propeller.

3. A motorized snowboard system comprising:

a. a motor;

b. mounted to a snowboard;

c. where said motor turns a wheel;

d. where said wheel is fitted with a snow propeller;

e. where said motor is mounted to said snowboard to allow said snow propeller to engage the snow surface to provide propulsion;

f. where a motor is mounted on both sides of a snow board; and g. where said motors mounted on both sides of said snowboard are mounted to said snowboard with a universal mounting plate.

4. The motorized snowboard system of claim 3 where mounting means are utilized to allow up and down motion of said motors, wheels, and snow propellers.

5. A motorized snowboard system comprising:

a. a motor;

b. mounted to a snowboard;

c. where said motor turns a wheel;

d. where said wheel is fitted with a snow propeller;

e. where said motor is mounted to said snowboard to allow said snow propeller to engage the snow surface to provide propulsion;

f. where a motor is mounted on both sides of a snow board; and g. where said motors are mounted on said snowboard in front of the rear binding of said snowboard.

6. The motorized snowboard system of claim 5 where mounting means are utilized to allow up and down motion of said motors, wheels, and snow propellers.

7. The motorized snowboard system of claim 6 where a single shock absorber connected to said motors provides downward force to said motors, wheels, and snow propellers.

8. The motorized snowboard system of claim 6 where a shock absorber is independently connected to each said motor and said snowboard to provide downward force to said motors, wheels, and snow propellers.

9. A motorized snowboard system comprising:

a. a motor;

b. mounted to a snowboard;

c. where said motor turns a wheel;

d. where said wheel is fitted with a snow propeller;

e. where said motor is mounted to said snowboard to allow said snow propeller to engage the snow surface to provide propulsion;

f. where a motor is mounted on both sides of a snow board; and g. where said motors are mounted on said snowboard in front of the rear binding of said snowboard with a universal mounting plate.

10. The motorized snowboard system of claim 9 where mounting means are utilized to allow up and down motion of said motors, wheels, and snow propellers.

11. The motorized snowboard system of claim 6 further comprising a pair of motors mounted in front of the front binding of said snowboard.

12. The motorized snowboard system of claim 10 further comprising a pair of motors mounted in front of the front binding of said snowboard with a universal mounting plate.

13. The motorized snowboard system of claim 10 where said motors are powered by a battery pack.

14. The motorized snowboard system of claim 13 where the direction and speed of said motor is controlled by an electronic speed control.

15. The motorized snowboard system of claim 14, where said electronic speed control is controlled by a hand held remote control.

16. The motorized snowboard system of claim 10 where a single shock absorber connected to said motors provides downward force to said motors, wheels, and snow propellers.

17. The motorized snowboard system of claim 10 where a shock absorber is independently connected to each said motor and said snowboard to provide downward force to said motors, wheels, and snow propellers.

18. A motorized snowboard system comprising:
a. a motor;
b. mounted to a snowboard;
c. where said motor turns a wheel;
d. where said wheel is fitted with a snow propeller;
e. where said motor is mounted to said snowboard to allow said snow propeller to engage the snow surface to provide propulsion;
f. where said motor is powered by a battery pack; and
g. where the direction and speed of said motor is controlled by an electronic speed control.

19. The motorized snowboard system of claim 18, where said electronic speed control is controlled by a hand held remote control.

20. A motorized snowboard system comprising:
a. a pair of battery powered motors;
b. mounted on both sides of a snowboard;
c. where said battery powered motors turn a wheel;
d. where said wheels are fitted with snow propellers;
e. where said motors are mounted to said snowboard to allow said snow propellers to engage the snow surface to provide propulsion;
f. where said battery powered motors are mounted by means to allow for up and down motion of said motors, wheels, and snow propellers; and
g. where a single shock absorber connects said motors to provide downward force to said motors, wheels, and snow propellers.

21. A motorized snowboard system comprising:
a. a pair of battery powered motors;
b. mounted on both sides of a snowboard;
c. where said battery powered motors turn a wheel;
d. where said wheels are fitted with snow propellers;
e. where said motors are mounted to said snowboard to allow said snow propellers to engage the snow surface to provide propulsion;
f. where said battery powered motors are mounted by means to allow for up and down motion of said motors, wheels, and snow propellers; and
g. where a shock absorber is independently connected to each said motor and said snowboard to provide downward force to said motors, wheels, and snow propellers.

22. The motorized snowboard system of claim 21, where said battery powered motors and said shock absorbers are mounted to said snow board with a universal mounting plate.

23. A motorized snowboard system comprising:
a. a pair of battery powered motors;
b. mounted on both sides of a snowboard;
c. where said battery powered motors turn a wheel;
d. where said wheels are fitted with snow propellers;
e. where said motors are mounted to said snowboard to allow said snow propellers to engage the snow surface to provide propulsion;
f. where said battery powered motors are mounted by means to allow for up and down motion of said motors, wheels, and snow propellers; and
g. where the direction and speed of said motor is controlled by an electronic speed control.

24. The motorized snowboard system of claim 23, where said electronic speed control is controlled by a hand held remote control.

25. A motorized snowboard system comprising:
a. a pair of battery powered motors;
b. mounted on both sides of a snowboard;
c. where said battery powered motors turn a wheel;
d. where said wheels are fitted with snow propellers;
e. where said motors are mounted to said snowboard to allow said snow propellers to engage the snow surface to provide propulsion;
f. where said battery powered motors are mounted by means to allow for up and down motion of said motors, wheels, and snow propellers; and
g. where said battery powered motors are mounted to said snow board with a universal mounting plate.

26. A motorized snowboard system comprising:
a. a pair of battery powered motors;
b. mounted on both sides of a snowboard;
c. where said battery powered motors turn a wheel;
d. where said wheels are fitted with snow propellers;
e. where said motors are mounted to said snowboard to allow said snow propellers to engage the snow surface to provide propulsion;
f. where said battery powered motors are mounted by means to allow for up and down motion of said motors, wheels, and snow propellers;
g. where a single shock absorber connects said motors to provide downward force to said motors, wheels, and snow propellers.

27. The motorized snowboard system of claim 26 where the direction and speed of said motors are controlled by an electronic speed control.

28. The motorized snowboard system of claim 27, where said electronic speed control is controlled by a hand held remote control.

29. The motorized snowboard system of claim 26, where said battery powered motors are mounted to said snow board with a universal mounting plate.

30. The motorized snowboard system of claim 26 where said snow propellers have a shape.

31. The motorized snowboard system of claim 26 where said snow propellers include attachment means with said wheel that allow said propellers to be easily interchanged.

32. A motorized snowboard system comprising:
a. a pair of battery powered motors;
b. mounted on both sides of a snowboard;
c. where said battery powered motors turn a wheel;
d. where said wheels are fitted with snow propellers;
e. where said motors are mounted to said snowboard to allow said snow propellers to engage the snow surface to provide propulsion;
f. where said battery powered motors are mounted by means to allow for up and down motion of said motors, wheels, and snow propellers;

g. where a shock absorber is independently connected to each said motor and said snowboard to provide downward force to said motors, wheels, and snow propellers.

33. The motorized snowboard system of claim 32 where each said motor, wheel, and snow propeller includes a means to disengage said motor, wheel, and snow propeller from the snow.

34. The motorized snowboard system of claim 33 where said means to disengage said motor, wheel and snow propeller from the snow is comprised of:

a. a hinge plate chain clip;

b. chain; and c. central chain clip.

35. The motorized snowboard system of claim 32 where the direction and speed of said motors are controlled by an electronic speed control.

36. The motorized snowboard system of claim 35, where said electronic speed control is controlled by a hand held remote control.

37. The motorized snowboard system of claim 32 where said snow propellers where said snow propellers have a shape.

38. The motorized snowboard system of claim 32 where said snow propellers include attachment means with said wheel that allow said propellers to be easily interchanged.

* * * * *